United States Patent [19]

Mink

[11] Patent Number: 4,955,207

[45] Date of Patent: Sep. 11, 1990

[54] COMBINATION HOT WATER HEATER-REFRIGERATION ASSEMBLY

[76] Inventor: Clark B. Mink, 648 Almeda Ct. No., St. Petersburg, Fla. 33702

[21] Appl. No.: 412,347

[22] Filed: Sep. 26, 1989

[51] Int. Cl.[5] ..... F28D 15/02; F24D 17/02

[52] U.S. Cl. ..... 62/238.6; 165/104.14; 165/104.21; 165/104.27

[58] Field of Search ..... 165/104.14, 104.21, 165/104.27; 62/238.6, 333

[56] References Cited

U.S. PATENT DOCUMENTS 4,524,822 6/1985 Hage et al. ..... 165/104.14

*Primary Examiner*—Albert W. Davis, Jr.

*Attorney, Agent, or Firm*—T. M. Gernstein

[57] ABSTRACT

A combination hot water heater-refrigeration assembly includes a refrigeration assembly coupled to a hot water tank via a heat pipe. The heat pipe has the heat releasing end thereof near the bottom of the hot water tank.

1 Claim, 3 Drawing Sheets

COMBINATION HOT WATER HEATER-REFRIGERATION ASSEMBLY

TECHNICAL FIELD OF THE INVENTION

The present invention relates to the general art of heat exchangers, and to the particular field of transferring heat energy to a hot water heater.

BACKGROUND OF THE INVENTION

In the typical vapor compression refrigeration system, various components, such as compressor, condenser, evaporator and expansion devices, are arranged to transfer heat energy between a fluid in a heat exchange relationship with an evaporator and fluid in heat exchange relation with the condenser. It is also known in conjunction with such refrigeration systems to utilize a desuperheater for removing superheat energy from gaseous refrigerant prior to circulating said refrigerant to the condenser. One application of such a refrigeration system is a central air conditioning system used in a building. In such application, an enclosure is cooled by circulating, and possibly re-circulating, air from a central air conditioning unit with the enclosure an with ambient air.

In a conventional building installation, a hot water heater is provided to supply heated water to an enclosure. Many such hot water heaters have a cold water inlet connected to an inlet extension pipe and a hot water outlet extending through the top of a hot water tank. Often, an inlet extension pipe is connected to the cold water inlet such that incoming water is directed to the bottom portion of the tank. In hot water tanks, water is heated at the bottom of the tank and rises such that a stratified tank with relatively warm water at the top and cool water at the bottom is provided. When demand is made for hot water, water is discharged from the top of the tank at its warmest temperature and cold water is supplied through the inlet to the bottom portion of the tank.

It is known to combine a refrigeration system and a hot water heating system such that the superheat of the refrigerant may be rejected to Water to be heated such that this heat may be utilized to provide hot water. This heated water may be used for bathing, cleaning, cooking or other uses in a residence. Commercial applications include restaurants, supermarkets, process utilization and any other application wherein waste energy or excess energy from a refrigeration system may be available and hot Water from a tank is also needed.

However, such known systems have several drawbacks that have inhibited their full commercial acceptance. Principal among such drawbacks is the inefficient use made of heat supplied to the hot water heater by the refrigeration system. This inefficient use of heat is coupled with the detriment to the performance of the refrigeration system caused by the hot water heating system. Together, these drawbacks have combined in such a manner such that the increase in hot water heating efficiency has not been sufficient to offset or make up for the reduction in refrigeration efficiency.

Therefore, there is a need for a system which utilizes heat associated with a refrigeration system to heat water in a hot water tank with sufficient efficiency to make such a combination economically feasible an efficient.

OBJECTS OF THE INVENTION

It is a main object of the present invention to provide a combination hot Water heater and refrigeration assembly which utilizes heat associated with a refrigeration system to heat water in a hot water tank.

It is another object of the present invention to provide a combination hot Water heater and refrigeration assembly which utilizes heat associated with a refrigeration system to heat water in a hot water tank and which has sufficient efficiency to make such a combination economically feasible and efficient.

SUMMARY OF THE INVENTION

These, and other, objects are achieved by including a heat pipe in a hot water tank to transfer heat provided from a refrigeration system to the hot water tank. The heat pipe not only transfers the heat efficiently, it can do so at the locations that most efficiently use such heat in the hot water tank. The system further includes a pressure control unit connected to the line connecting the hot water tank heat exchanger unit to the condenser of the refrigeration unit. This pressure control unit senses the pressure in this line, and increases it to further insure that the refrigeration system works efficiently.

For the purposes of this disclosure, a heat pipe is a cylindrical element which absorbs heat at one end by vaporization of a liquid and release heat at the other end by condensation of the vapor.

DETAILED DESCRIPTION OF THE PREFERRED EMBODIMENT OF THE INVENTION

Figure 1:
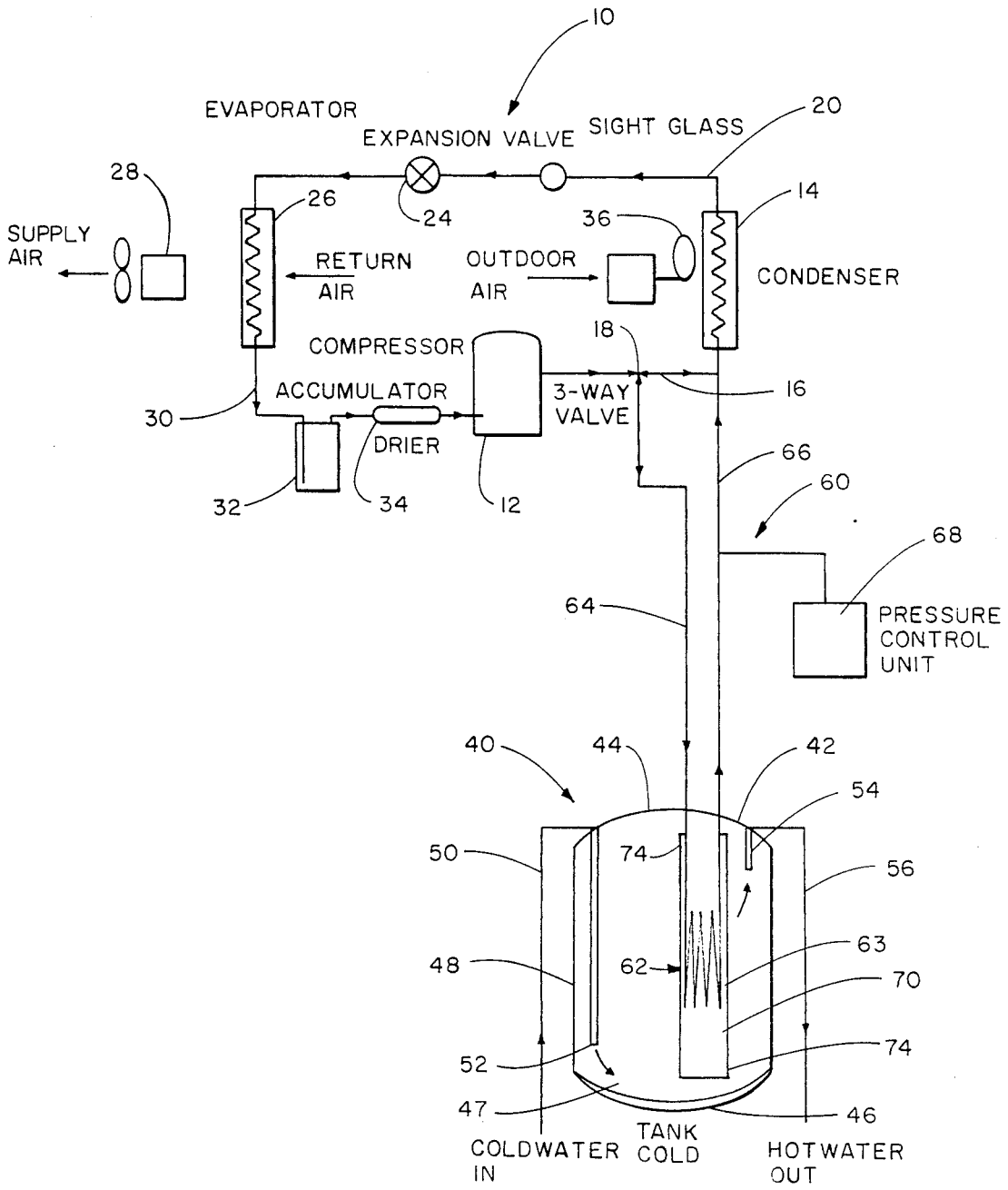
FIG. 1 is a schematic illustration of a combination hot water heater-refrigeration assembly embodying the present invention.

Shown in FIG. 1 is a vapor compression refrigeration system 10 having a compressor 12, which compresses suitable fluid, such as Freon, or the like, fluidically connected to a condenser 14 via a fluid line 16 having a three-way valve 18 therein. Condensed fluid from condenser 14 is transferred via line 20 having a sight glass 22 therein to an expansion valve 24, and thence to an evaporator 26. The evaporator 26 is fluidically coupled to an air moving unit, such as fan 28 to cool air, such as return air, and to send that cooled air into the area to be cooled via a duct system (not shown) or the like.

Fluid from the evaporator 26 is returned to the compressor 12 via a fluid line 30 fluidically coupling the evaporator to an accumulator 32 and to a drier 34. Vapor is cooled in the condenser 14 by outside air drawn past the condenser by a blower 36. Return air from the conditioned space is drawn through the air-side passages of the evaporator 26 and the air coil therein by the bloWer 28, which discharges the conditioned air to the conditioned space.

Operation of the refrigeration system 10 will be evident to those skilled in the art, and thus will not be reviewed. Reference is made to disclosures such as found in U.S. Pat. Nos. 4,281,519 and 4,798,240, the disclosures of which are incorporated herein by reference, for such discussion.

The system also includes a hot water heater unit 40 for heating cold water from a supply (not shown) and supplying such heated water to a building associated therewith. The hot water heater unit includes a tank 42 having a top 44, a bottom 46 and a side wall 46 connecting such top and bottom together to form a tank that is suitable for containing water to be heated. A heating unit 47 is included to heat the water in the normal manner, such as by electrical resistance heating or the like. Water to be heated is supplied to the tank via a fluid line 50. The fluid line 50 has an end 52 that is located in the tank 42 adjacent to the bottom and which serves as the inlet for cold water. This inlet is located near the bottom of the tank to take advantage of the natural convection currents associated with water that is stratified according to temperature. Since hot water will naturally rise with respect to cold water, placing the cold water inlet near the bottom will take advantage of this characteristic of water.

The water tank 42 also includes a hot Water outlet 54 that is located adjacent to the top 44 of the tank to further take advantage of such natural convection. The hot water outlet is connected to a hot water delivery line 56 that is fluidically connected to the elements in the building that will use the hot water.

The assembly further includes a water heating heat transfer system 60 for transferring heat from the refrigeration system 10 to water contained in the tank 42 to assist in the heating of that water. This system 60 includes a heat exchanger unit 62 positioned in the hot water tank 42 and which includes a heat exchange element 63 fluidically connected to the compressor 12 via an inlet fluid line 64 connected to the three-way valve 18 to conduct hot fluid from the compressor 12 to the interior of the tank 42. The fluid from compressor is conducted into the tank to transfer heat thereto since the fluid exiting the compressor can be as high as 240° F. and the water in the tank is less than this temperature. The heat exchange fluid exits the heat exchange element 63 via an outlet fluid line 66 which is fluidically connected to the compressor.

In order to control the pressure of the fluid entering the compressor, the assembly includes a pressure control unit 68 connected to the outlet fluid line 66. The pressure control unit includes a pressure sensor sensing the pressure in the fluid line 66 and a pressurizing unit as well as a vent valve so that if the pressure at the inlet of the condenser is either too high or too low, the pressure control unit will sense such out-of-range state condition and correct the error accordingly. In this manner, the pressure in the refrigeration system will remain optimum even though the system is connected to a heat exchanger. Thus, the efficiency of the refrigeration system will not be adversely affected by the hot water heating system.

Figure 2:
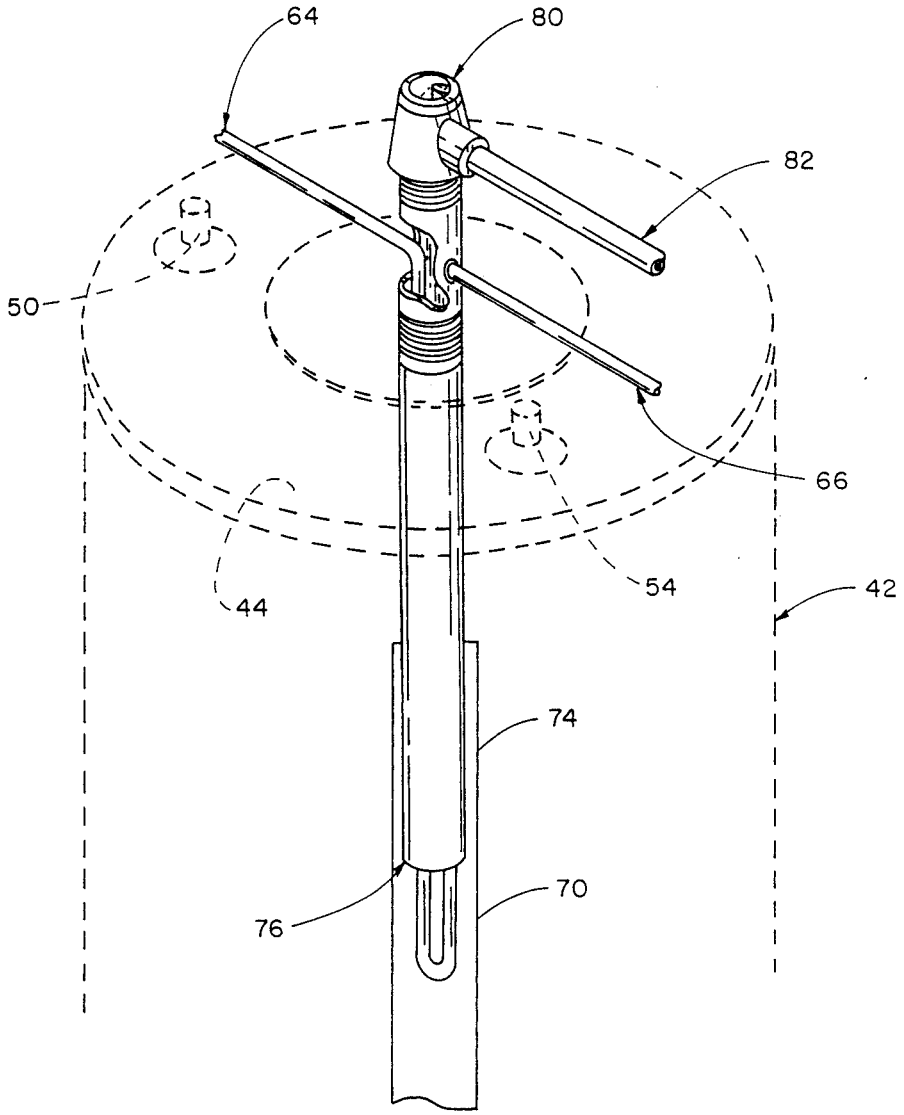
FIG. 2 illustrates the hot water tank unit of the present invention showing a heat pipe used to transfer heat to water stored in the hot water tank.
Figure 3:
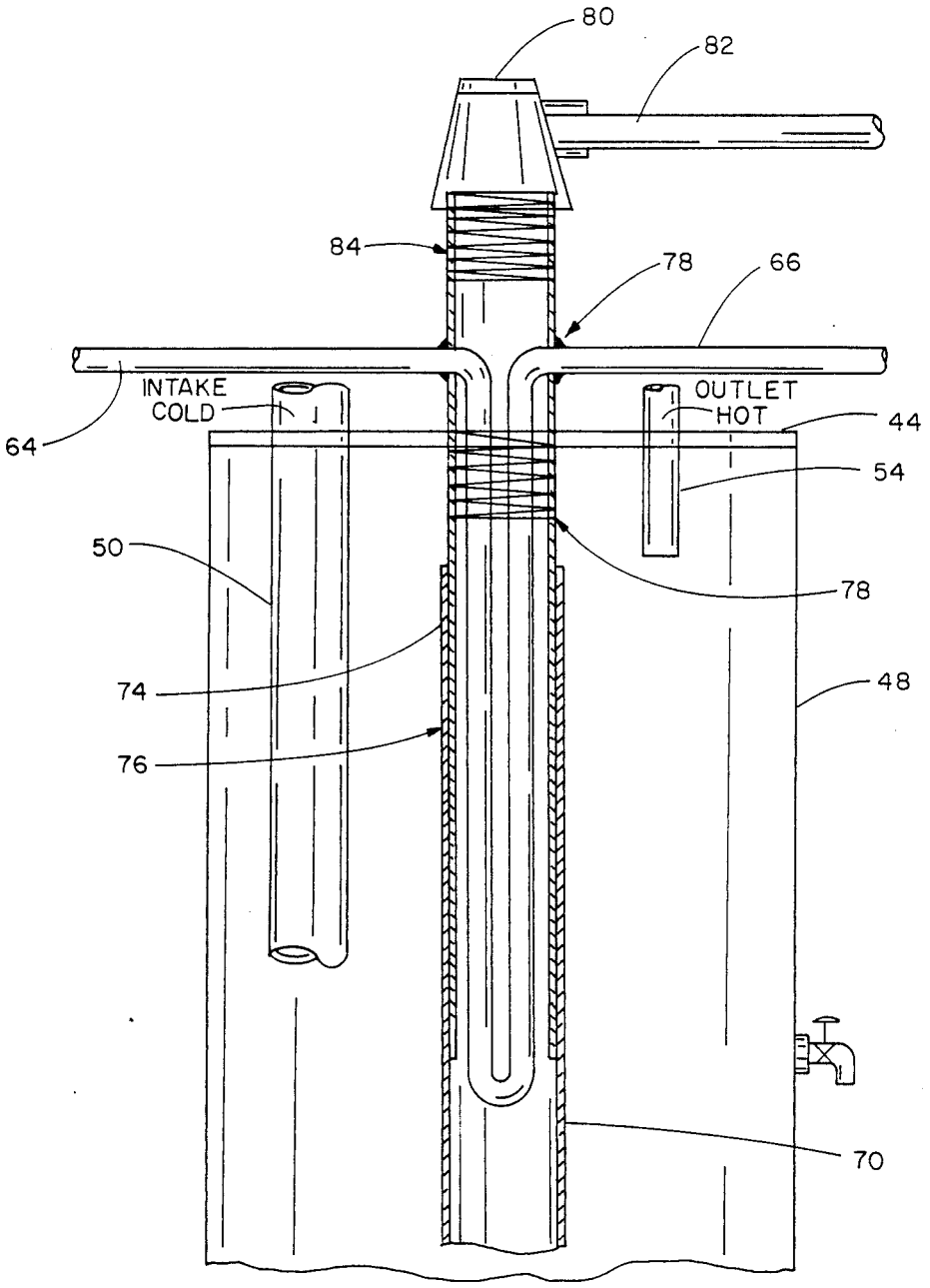
FIG. 3 is an elevational view of the hot water tank unit of the present invention.

As is shown in FIGS. 1, 2 and 3, the heat transfer system includes a heat pipe 70 located in the hot water tank 42 to transfer heat to the water in such tank. The heat pipe absorbs heat at one end 72 which is in heat transferring association with the heat exchange element 63 by vaporization of a liquid and releases heat at the other end 74 that is located near the bottom of the tank 42 by condensation of that vapor. A heat pipe is a well known heat transfer element, and those skilled in the heat transfer art will be able to understand what type of heat pipe and its characteristics will be required based on the teaching of the present disclosure, and from textbooks such as "Advances in Heat Transfer, Volume 1", edited by T. F. Irvine and J. P. Hartnett, and published in 1964 by Academic Press, especially pages 123–184.

Positioning the heat releasing end of the heat pipe nea the bottom of the tank 42 increases the natural convection temperature gradients by heating the water in the bottom of the tank. These natural convection gradients will serve to stir the water in the tank and increase the heat transfer efficiency of the hot water heating system. Since a heat pipe is an efficient heat transferring element the overall system efficiency is quite high. Further, since the heat releasing end of the heat pipe is situated near the bottom of the tank, the heat transfer efficiency is again increased. Thus, the water heating system of the present invention has a vary high efficiency, while the refrigeration system of the invention retains its efficiency. Thus, the overall system is quite efficient.

As is best shown in FIGS. 2 and 3, the heat exchanger unit 62 includes a sleeve 76 soldered to the tank by silver solder 78, or the like and connected to a popoff valve 80 having a relief tube 82 associated therewith via a nipple 84.

Operation of the device is evident from the foregoing, and thus will not be discussed in detail.

It is understood that while certain forms of the present invention have been illustrated and described herein, it is not to be limited to the specific forms or arrangements of parts described and shown.

What is claimed:

1. A combination hot water heater-refrigeration assembly comprising:

(A) a hot water heater unit which includes
  (1) a tank for containing water to be heated, said tank having a bottom and a top with a cold water inlet located adjacent to said bottom and a hot water outlet located adjacent to said top, and
  (2) heater means for heating the water contained in the tank;

(B) a refrigeration system which includes
  (1) a compressor for compressing fluid, such as Freon.
  (2) a condenser fluidically connected to said compressor and receiving compressed fluid therefrom,
  (3) a three-way valve fluidically connecting said compressor to said condenser; and (C) a water heating heat transfer system which includes
  (1) a heat exchange element in said hot water heater unit tank,
  (2) an inlet fluid line fluidically connecting said three-way valve to said heat exchange element and conducting fluid from said compressor to said heat exchange element,
  (3) an outlet fluid line fluidically connecting said heat exchange element to said condenser and conducting fluid from said heat exchange element to said condenser,
  (4) a heat pipe in said tank and having a heat absorber at one end in heat transferring association with said heat exchange element, said heat pipe having a heat releaser at another end in heat transferring association with water located adjacent to the bottom of the tank,
  (5) said heat exchange unit including a sleeve located inside said heat pipe, and
  (6) a pressure control unit connected to said outlet fluid line.

* * * * *